United States Patent [19]

Fischer

[11] Patent Number: 4,728,304

[45] Date of Patent: Mar. 1, 1988

[54] LOW INSERTION FORCE LEAD SOCKET INSERT

[75] Inventor: Charles P. Fischer, Mickelton, N.J.

[73] Assignee: Micro Stamping Corp., Maplewood, N.J.

[21] Appl. No.: 718,973

[22] Filed: Apr. 2, 1985

[51] Int. Cl.[4] ..... H01R 13/11

[52] U.S. Cl. ..... 439/842; 439/857

[58] Field of Search ..... 339/258 R, 258 P, 258 F, 339/258 RR, 258 T, 262 R, 262 RR, 276 R, 276 T, 278 C, 278 T, 278 M

[56] References Cited

U.S. PATENT DOCUMENTS 3,145,069 8/1964 Damon et al. ..... 339/218 R 4,687,278 8/1987 Grabbe et al. ..... 439/842

FOREIGN PATENT DOCUMENTS 0087894 9/1983 European Pat. Off. ..... 339/258 R

*Primary Examiner*—Gil Weidenfeld

*Assistant Examiner*—Paula A. Austin

*Attorney, Agent, or Firm*—Blum Kaplan

[57] ABSTRACT

An improved lead socket insert assembled into a contact member which is adapted to pluggably receive a lead of a circuit component, such as an integrated circuit package is provided. The insert has a hollow cylindrical body portion and fingers that are bent at a fulcrum position so that they converge. The insert has improved operational characteristics which engage a component lead with greatly reduced mating forces due to a weakening at the fulcrum position. The lead socket insert allows for higher density application of electronic packages when assembled into loose contact members or directly mounted into an interconnection panel.

18 Claims, 6 Drawing Figures

FIG. 4
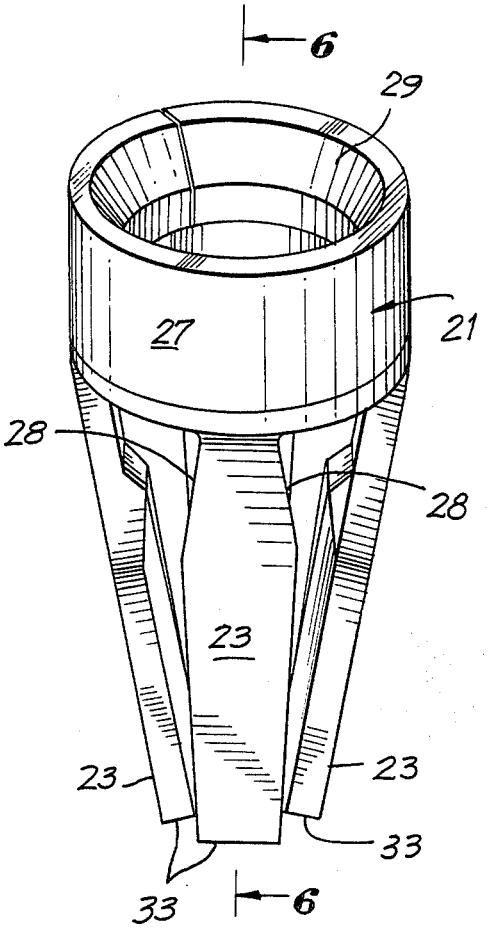
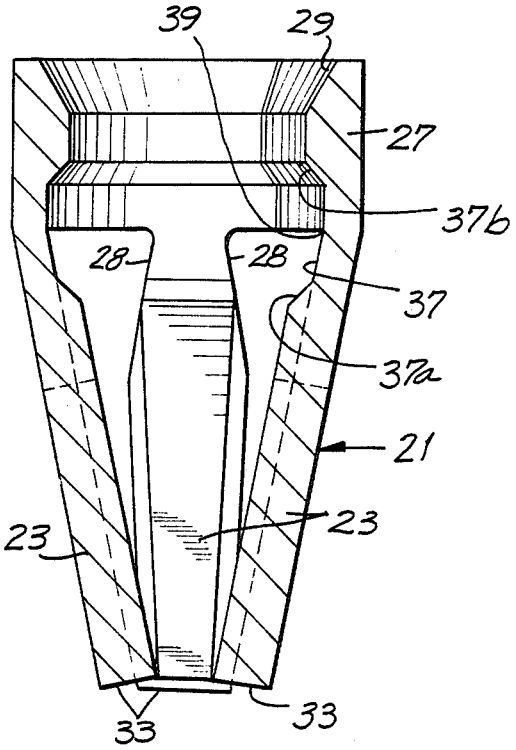
FIG. 6
FIG. 5
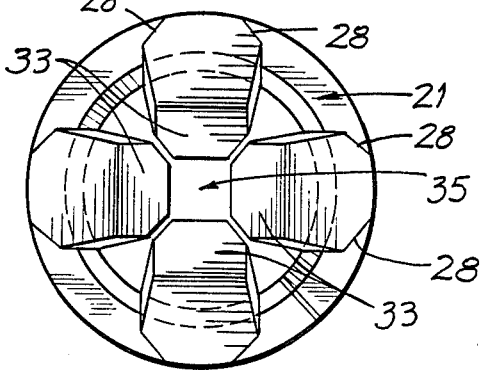

LOW INSERTION FORCE LEAD SOCKET INSERT

BACKGROUND OF THE INVENTION

This invention relates generally to an electrical interconnection apparatus and more specifically to an electrical interconnection low insertion force lead socket insert for facilitating the interconnection of leads to an electrical interconnection panel board or socket.

Socket contacts of the type to which this invention relates have been used widely in the industry for the purpose of receiving leads of electronic components. These socket contacts are mounted into pin grid array, dual-in-line and quad-in-line sockets or interconnection panel boards. The socket's contact is generally a two piece construction with the components being a lead socket insert and a machined terminal pin. The lead socket insert is press fitted to the terminal pin providing for a gas-tight interface with the component parts.

Heretofore, known lead socket inserts have been less than completely satisfactory because the converging fingers of the insert have been sized or spread, in effect over stressing the cantilever beam in order to reduce the mating forces. This creates an inherent beam effect in the fingers which causes excessive stress to occur at the fulcrum point of the beam. This condition severely impacts contact reliability during normal operating temperatures where in effect the cantilever beams can become stress relieved. As a result thereof, loss of contact of one or more converging fingers with the component lead can occur. Additionally, the sizing operation of the converging fingers often cause them to be moved into close proximity to each other. This often allows a mating component lead to skew or to penetrate between two of the converging fingers and also limits the size and configuration of the component lead that can be mated to it. This is due to the opened condition of the converging fingers, which will not make consistent contact to leads having a minimum diameter or rectangular cross-section. Accordingly, it is desirable to provide a lead socket insert having improved mating and unmating forces.

SUMMARY OF THE INVENTION

Generally speaking, in accordance with the invention, a low insertion force lead socket insert provides lower mating forces to component leads which are inserted therein, while maintaining uniform stress distribution to each of the converging fingers. The insert is formed having a hollow collar shaped body portion and a plurality of fingers that are bent at a fulcrum position toward each other so that the fingers are disposed in registry with each other. Each finger is weakened at the fulcrum position in order to reduce the flexible strength of each finger. This, in turn, reduces the friction force of the fingers when a lead is inserted. In a preferred embodiment, each finger decreases in width as it tapers toward the body portion and has an undercut disposed at the fulcrum position.

Accordingly, it is an object of the invention to provide an improved lead socket insert.

It is another object of the invention to provide a low insertion force lead socket insert.

Still another object of the invention is to provide a lead socket insert having uniform stress distribution at each of the fingers thereof.

A further object of the invention is to enable the insertion of multi-sized and shaped component leads into the socket insert.

Still other objects and advantages of the invention will in part be obvious and will in part be apparent from the specification.

The invention accordingly comprises the features of construction, combination of elements, and arrangements of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 4 is a perspective view of the low insertion force lead socket insert constructed in accordance with a preferred embodiment of the instant invention;

FIG. 5 is a bottom view of the insert; and

FIG. 6 is a sectional view taken along lines 6—6 of FIG. 4.

DETAILED DESCRIPTION OF THE PREFERRED EMBODIMENTS

Figure 1:
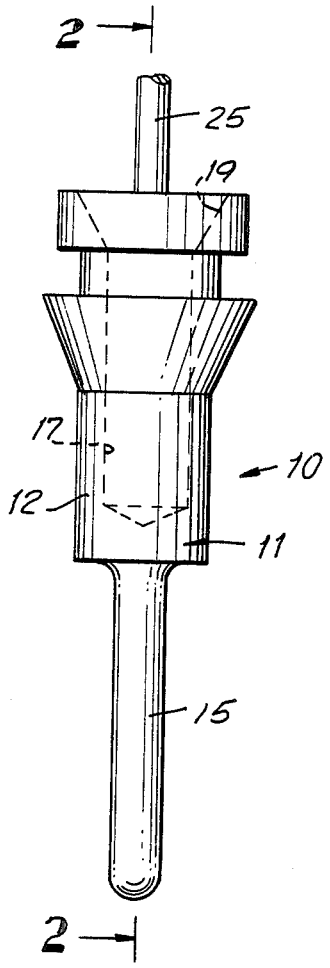
FIG. 1 is an elevational view of the low insertion force socket assembly of the instant invention.
Figure 2:
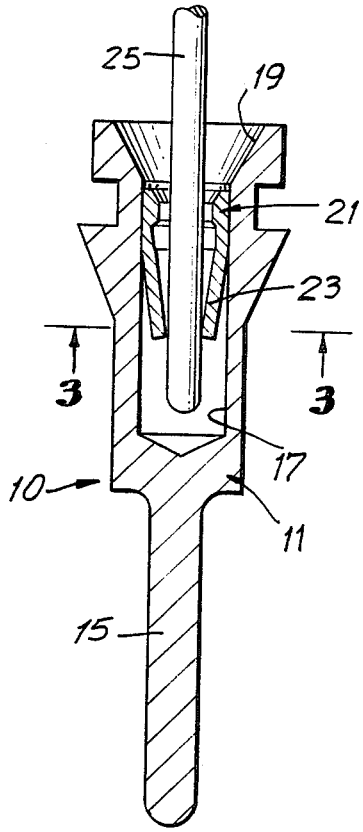
FIG. 2 is a sectional view taken along lines 2—2 of FIG. 1.
Figure 3:
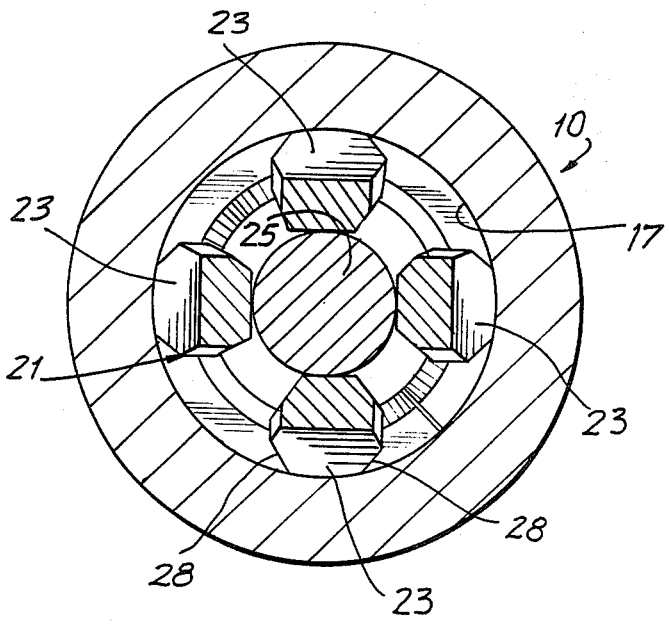
FIG. 3 is a horizontal cross-section view taken along lines 3—3 of FIG. 1.

Reference is made to FIGS. 1 through 3, wherein an improved low insertion force two-piece socket contact assembly, generally indicated at 10, is depicted. A terminal pin, generally indicated as 11, includes cylindrical outer sleeve 12 connected to a cylindrical elongated interconnection extension 15. An interior bore 17 of sleeve 12 has a tapered surface 19 for receiving therein a socket insert 21. Insert 21 is force fitted into bore 17 and is formed with converging flexible fingers 23 which are adapted to receive a circuit component lead 25. Lead 25 is securely received by flexible fingers 23, when lead 25 is inserted therein.

Referring specifically to FIGS. 4 through 6, socket insert 21 includes a collar shaped cylindrical wall 27 defining a tapered entry 29. Oar shaped fingers 23 extend from a join 39 in the cylindrical wall. Each finger 23 is decreased in width at the cylindrical wall 27 and are increased in width at the tips 33 of each finger. Tapered walls 28 of fingers 23 are formed by a trimming process. At tips 33, it is preferred that the fingers 23 are at equal angles with respect to each other, and approach but do not touch one another to define a gap therebetween, generally indicated as 35 (FIG. 5).

An undercut 37 formed in the insert extends from the area **37*a* of the finger where the finger is decreased in width to area 37*b* in the cylindrical wall 27, which reduces the thickness of finger 23 at join 39. Undercut 37** is formed by a coining process whereby metal, used to form the insert, is formed prior to the process used to form the cylindrical wall.

The decreased width of fingers 23 at tapered walls 28 and undercut 37 has the effect of reducing the flexible strength of each of the four fingers. This, in turn, requires lower mating forces to component leads which are insertably connected to the socket insert. In addition, the construction of fingers 23 provides protection from component lead distortion and allows acceptance of smaller component lead configurations.

Furthermore, the reduction in the stress at the fulcrum point of the beam of each finger permits the respective tips 33 of each finger to reduce better contact when a lead is inserted therebetween. If fingers 23 are bent back from each other, there is an increased risk that the fingers will make insufficient contact with the lead inserted therein.

As illustrated in FIG. 5, it is preferred that the tip 33 of each of the fingers be at 90° angles with respect to each other, and within 0.002 inches of each other. In a preferred embodiment, the length of fingers 23 is about 0.060 inches, the length of cylindrical wall 27 is about 0.022 inches and the diameter of wall 27 is about 0.044 inches.

In an exemplary embodiment, the lead socket insert is stamped, coined and formed from a flat piece of strip metal. After completion of the stamping and forming process, additional finishing and plating operations are performed: heat treating (for approximately 2 hours at 600° F. in an insert atmosphere), tumbling, gold or tin plating, etc. The finished insert is then assembled with a contact member. This assembly is accomplished by an interference or "press" fit. The "press" fit operation is used because the outside diameter of the insert is greater than the inside diameter of the contact member. The compression of the insert into the hole of the contact member provides for a gas tight joint or interface between the two components. This is required for the electrical characteristics of the product to be realized.

The contact member can be of two basic types with several variations of each type. Type A, referred to as a socket type, is commonly used when further asembled with an insulator housing of varying grid patterns for use in interconnecting dip, sip and hybrid type electronic components. Type B, commonly referred to as panel type, is used when assembly of the terminal pin is required directly into a printed circuit board. The panel type is used in varying grid patterns and is commonly used as well in wire wrapped panels, wire wrap I.C. sockets, and custom I.C. adapter sockets, etc.

The primary metallic material for constructing the lead socket insert is beryllium copper. A general characteristic is that the metal should be an age hardenable alloy. As discussed above, after the material is stamped, it must be heated at a specific temperature in order to temper the material.

It will thus be seen that the objects set forth above, among those made apparent from the preceding description are efficiently attained and, since certain changes may be made in carrying out the invention described without departing from the spirit and scope of the invention, it is intended that all the matter container in the above description shall be interpreted as illustrative and not in a limiting sense.

It is also to be understood that the following claims are intended to cover all the specific features of the invention herein described, and all statements of the scope of the invention which, as a matter of language, might be said to fall therebetween.

What is claimed is:

1. A lead socket insert comprising a collar and a plurality of fingers, each finger having a first and a second end, each said finger being joined to said collar at said first end, and each of said fingers being bent at a fulcrum position toward each other so that said fingers converge and are disposed in registry with each other to permit the fingers to converge about a lead that is inserted therebetween, said first end at said fulcrum position where said fingers are bent toward each other being structurally weakened to reduce the flexible strength of each finger so that the friction force of said fingers is reduced when a lead is inserted therein.

2. A lead socket, as claimed in claim 1, wherein each said fingers has a reduced cross section extending from said fulcrum position at said collar along a lengthwise portion thereof, said tapered cross-section causing weakening of said fulcrum position.

3. A lead socket insert, as claimed in claim 2, wherein each said finger increases in width from said fulcrum position along a lengthwise portion thereof.

4. A lead socket insert, as claimed in claim 3, wherein each of said fingers are oar shaped.

5. A lead socket insert, as claimed in claim 3, wherein said fingers are formed by a trimming process.

6. A lead socket insert, as claimed in claim 2, wherein an undercut is disposed at the fulcrum position of each finger, thereby reducing the thickness of each said finger along a portion thereof so that the flexible strength of each said finger is reduced.

7. A lead socket insert, as claimed in claim 6, wherein said fingers are formed by a coining process.

8. A lead socket insert, as claimed in claim 6, wherein said insert is formed with four fingers.

9. A lead socket insert, as claimed in claim 1, wherein said collar is cylindrical.

10. A lead socket insert, as claimed in claim 9, wherein said cylindrical collar is formed with a beveled entry opening.

11. A lead socket insert, as claimed in claim 1, wherein said insert is formed with four fingers.

12. A lead socket insert, as claimed in claim 11, wherein said second ends of said fingers are oriented at 90° angles with respect to each other.

13. A lead socket insert, as claimed in claim 12, wherein said second end of said fingers are at or about 0.002 inches from each other.

14. A lead socket insert, as claimed in claim 1, wherein said insert is made of an aged hardenable alloy.

15. A lead socket insert, as claimed in claim 14, wherein said hardenable alloy is beryllium copper.

16. A lead socket insert, as claimed in claim 1, wherein said insert is initially stamped and formed from a flat piece of strip metal and thereafter finished and plated by one of the steps of heat treating, tumbling or gold or tin plating.

17. A lead socket insert, as claimed in claim 16, wherein said metal is an aged hardenable alloy.

18. A lead socket insert comprising a cylindrical collar and four fingers, each finger having a first and a second end, each said finger being joined to said collar at said first end, and each of said fingers being bent at a fulcrum position toward each other so that said fingers converge and are disposed in registry with each other to permit the fingers to converge about a lead that is inserted therebetween, each said finger increased in width from said fulcrum position along a lengthwise portion thereof and having an undercut disposed at the fulcrum position to reduce the flexible strength of each finger so that the friction force of said fingers is reduced when a lead is inserted therein.

* * * * *